US009869061B2

(12) United States Patent
Buschman et al.

(10) Patent No.: US 9,869,061 B2
(45) Date of Patent: Jan. 16, 2018

(54) HINGE/TAPER CLAMP ROD HOLDER INSERT

(71) Applicants: Thomas Westlake Buschman, Kirtland, OH (US); Westlake David Buschman, Willoughby Hills, OH (US)

(72) Inventors: Thomas Westlake Buschman, Kirtland, OH (US); Westlake David Buschman, Willoughby Hills, OH (US)

(73) Assignee: Buschman Corporation, Cleveland, OH (US)

( * ) Notice: Subject to any disclaimer, the term of this patent is extended or adjusted under 35 U.S.C. 154(b) by 0 days.

(21) Appl. No.: 13/961,061

(22) Filed: Aug. 7, 2013

(65) Prior Publication Data

US 2014/0041577 A1 Feb. 13, 2014

Related U.S. Application Data

(60) Provisional application No. 61/681,397, filed on Aug. 9, 2012.

(51) Int. Cl.

| | |
|---|---|
| ***B05C 11/02*** | (2006.01) |
| ***D21H 25/06*** | (2006.01) |
| ***B05C 11/04*** | (2006.01) |
| ***D21H 25/08*** | (2006.01) |
| ***D21G 3/00*** | (2006.01) |
| ***D21H 25/12*** | (2006.01) |
| *B05C 1/08* | (2006.01) |
| *D21G 3/04* | (2006.01) |

(52) U.S. Cl.

CPC ..... *D21H 25/06* (2013.01); *B05C 1/0817* (2013.01); *B05C 11/021* (2013.01); *B05C 11/025* (2013.01); *B05C 11/044* (2013.01); *D21G 3/00* (2013.01); *D21H 25/08* (2013.01); *D21H 25/12* (2013.01); *B05C 1/0834* (2013.01); *D21G 3/005* (2013.01); *D21G 3/04* (2013.01); *Y10T 29/49826* (2015.01)

(58) Field of Classification Search

CPC ... B05C 1/0817; B05C 1/0834; B05C 11/021; B05C 11/025; B05C 11/044; D21G 3/00; D21G 3/005; D21G 3/04; D21H 25/06; D21H 25/12; D21H 25/08; Y10T 29/49826

USPC ..... 118/110, 123, 126, 262, 414; 162/281; 101/120; 15/256.5, 256.51, 256.52

See application file for complete search history.

(56) References Cited

U.S. PATENT DOCUMENTS 4,367,691 A * 1/1983 Bergs ..... B05C 11/025 118/119

6,911,085 B2 6/2005 Knop (Continued)

FOREIGN PATENT DOCUMENTS

EP 1 485 209 12/2004

WO WO 2010/142513 * 12/2010

*Primary Examiner* — Laura Edwards

(74) *Attorney, Agent, or Firm* — Fay Sharpe LLP

(57) ABSTRACT

A metering rod assembly including a body for accommodating a metering rod insert and configured to clamp the metering rod and/or metering rod insert without the use of an auxiliary clamping device, such as a pressure tube or the like. A rod bed insert is supported in a tapered channel of a body whereby a clamping action is created during use. In another embodiment, the body includes a hinge portion that facilitates relative rotation between upper and lower jaws to create a clamping action during use.

12 Claims, 3 Drawing Sheets

(56) References Cited

U.S. PATENT DOCUMENTS

| | | | | |
|---|---|---|---|---|
| 7,798,093 | B2 * | 9/2010 | Kautto et al. | 118/123 |
| 8,028,648 | B2 * | 10/2011 | Karusalmi et al. | 118/110 |
| 2013/0008373 | A1 * | 1/2013 | Rousu | 118/258 |

* cited by examiner

HINGE/TAPER CLAMP ROD HOLDER INSERT

CROSS REFERENCE TO RELATED PATENTS AND APPLICATIONS

This application claims priority to and the benefit of the filing date of U.S. Provisional Patent Application Ser. No. 61/681,397, filed Aug. 9, 2012, which application is hereby incorporated by reference.

BACKGROUND

The present application relates to the general field of paper manufacturing. It relates in particular to metering rod assemblies used in the chemical treatment of paper during various coating processes.

During the coating process, a coating or metering rod assembly lays against a high speed transfer roller. A generous chemical coating is applied to the transfer roller. Excess coating is removed by the metering rod assembly leaving only a thin film of chemical treatment or coating on the transfer roller. Then the coating is transferred to a web. In some instances, an excess amount of coating is applied directly to the web and then the excess is removed with the metering rod.

The metering rod assembly includes a body having a rod channel (rod holder) that is designed to receive a metering rod (sometimes referred to as a doctor blade). The metering rod is generally, but not always, small in diameter and can be very long in length (up to 15 meters). During the coating process, the metering rod primarily controls the coating film thickness. In addition, the rod is rotated within the rod channel to provide uniform wear along the circumference of the rod.

Both metering rods and rod holders are wear parts that have service lives, depending on the application, anywhere from a few hours to a few months. The part of the rod holder that typically wears out is called a cradle and includes the rod channel in which the metering rod rotates. As the metering rod rotates, friction between the metering rod and the cradle, combined with sometimes abrasive coatings and other factors, causes the "lips" of the rod holder cradle to wear down.

In some instances, the cradle is included in an insert that is received in the body of the rod assembly. Such inserts allow replacing the cradle without having to replace the entire body resulting in a cost savings to the customer. Known metering rod assemblies utilizing an insert have generally required replacement of a conventional body with a body designed to accommodate an insert. A body configured to accommodate an insert generally will include one or more features designed to enable clamping the insert in the body to reduce or eliminate vibration and/or unintended separation of the insert from the body. For example, pneumatic clamping tubes are often supported by the body and used for securing an insert in a channel or groove of the body. Such clamping tubes can be pressurized to achieve a variable clamping effect on a metering rod.

While metering rod assemblies utilizing inserts and clamping pressure tubes have met with commercial success, the addition of clamping pressure tubes to the metering rod assemblies complicates the device, increases cost, and can result in an increased risk of operator errors or equipment failure. In addition, upgrading a metering rod assembly to accommodate an insert with the variable clamping features described above typically requires replacing the body of the assembly with a body equipped with a clamping pressure tube, and plumbing pneumatic lines to the body to inflate the pressure tube, and a control unit. This increases costs and complexity of metering rod assemblies.

BRIEF DESCRIPTION

The present disclosure sets forth a metering rod assembly including a body for accommodating a metering rod insert and configured to clamp the metering rod and/or metering rod insert without the use of an auxiliary clamping device, such as a pressure tube or the like.

In accordance with one aspect, a metering rod assembly for supporting a metering rod in compressive engagement with an associated roller of a paper machine comprises a base member mountable to a support, the base member having a channel opening to a first face thereof and having first and second side walls spaced about a central plane of the channel, and a rod bed insert at least partially received in the channel of the base member, the rod bed insert having a metering rod slot for receiving a metering rod. When a metering rod is installed in the metering rod slot, a force applied parallel to the central plane placing the metering rod in compressive engagement with the associated roller urges said side walls towards each other thereby clamping the rod bed insert in the channel of the base member.

At least one of the first and second side walls of the channel can extend at a non-zero angle relative to the central plane of the channel in a taper fit manner, whereby as the metering rod urges the rod bed insert deeper into the channel the first and second side walls of the base member clamp the rod bed insert in the channel. The rod bed insert can be configured to be closely received in the channel, first and second side walls of the insert having a mating shape to the first and second side walls of the channel. The rod bed insert can include a necked down portion thereof connecting the first and second side walls of the rod bed insert. The base member can further include a mount portion adapted to be secured to a support, a head portion, and a hinge portion connecting the mounting portion and the head portion. The assembly can further comprise a pressure tube for applying the force to the head portion of the base member, the pressure tube operative to compressively engage a metering rod with the associated roller and urge said side walls of the channel towards each other thereby clamping the rod bed insert in the channel of the base member.

The metering rod insert can include a retaining element adapted to cooperate with a corresponding retaining element of the base member to restrict separation of the metering rod insert from the base member. The retaining elements can include at least one protrusion and at least one recess into which the protrusion is received. The metering rod insert can include at least one tab including the at least one protrusion. At least one of the base member or the rod bed insert can be comprised of a resilient material. The assembly can further comprise a pressure tube for applying the force to the base member, the pressure tube operative to compressively engage a metering rod with the associated roller and clamp the rod bed insert in the base member.

In accordance with another aspect, a method of securing a metering rod in a metering rod base member comprises the steps of providing a base member mountable to a support, the base member having a channel opening to a first face thereof and having first and second side walls spaced about a central plane of the channel, inserting a rod bed insert at least partially in the channel of the base member, the rod bed insert having a metering rod slot for receiving a metering rod, inserting a metering rod in the metering rod slot of the rod bed insert, and applying a force parallel to the central plane to thereby place the metering rod in compressive engagement with an associated roll, whereby the side walls of the rod bed insert are urged towards each other thereby clamping the rod bed insert in the channel of the base member.

In accordance with yet another aspect, a metering rod assembly for supporting a metering rod in compressive engagement with an associated roll of a paper machine comprises a base member including a channel opening to a first face thereof and having first and second side walls spaced about a central plane of the channel, a mount portion adapted to be secured to a support, a head portion, and a hinge portion connecting the mounting portion and the head portion, and a rod bed insert at least partially received in the channel of the base member, the rod bed insert having a metering rod slot for receiving a metering rod. When a metering rod is installed in the metering rod slot, a force applied to the head portion in a direction parallel to the central plane placing the metering rod in compressive engagement with the associated roll urges said side walls towards each other thereby clamping the rod bed insert in the channel of the base member.

The rod bed insert can include a necked down portion thereof connecting the first and second side walls of the rod bed insert. The metering rod insert can include a retaining element adapted to cooperate with a corresponding retaining element of the base member to restrict separation of the metering rod insert from the base member. The retaining elements can include at least one protrusion and at least one recess into which the protrusion is received. The metering rod insert can include at least one tab including the at least one protrusion. The base member can be comprised of a resilient material. The assembly can further comprise a pressure tube for applying the force to the head portion of the base member, the pressure tube operative to compressively engage a metering rod with the associated roll and urge said side walls of the channel towards each other thereby clamping the rod bed insert in the channel of the base member.

Metering rod assemblies in accordance with the present disclosure include a replaceable rod bed insert that can be clamped to varying degrees without needing to provide a separate clamping pressure tube or the like. The disclosure sets forth a metering rod assembly that can be retrofit to existing machines without the need to plumb additional pneumatic lines and/or provide an additional controller, etc.

BRIEF DESCRIPTION OF THE DRAWINGS

The following is a brief description of the drawings, which are presented for the purpose of illustrating the exemplary embodiments disclosed herein and not for the purpose of limiting the same.

DETAILED DESCRIPTION

Figure 1:
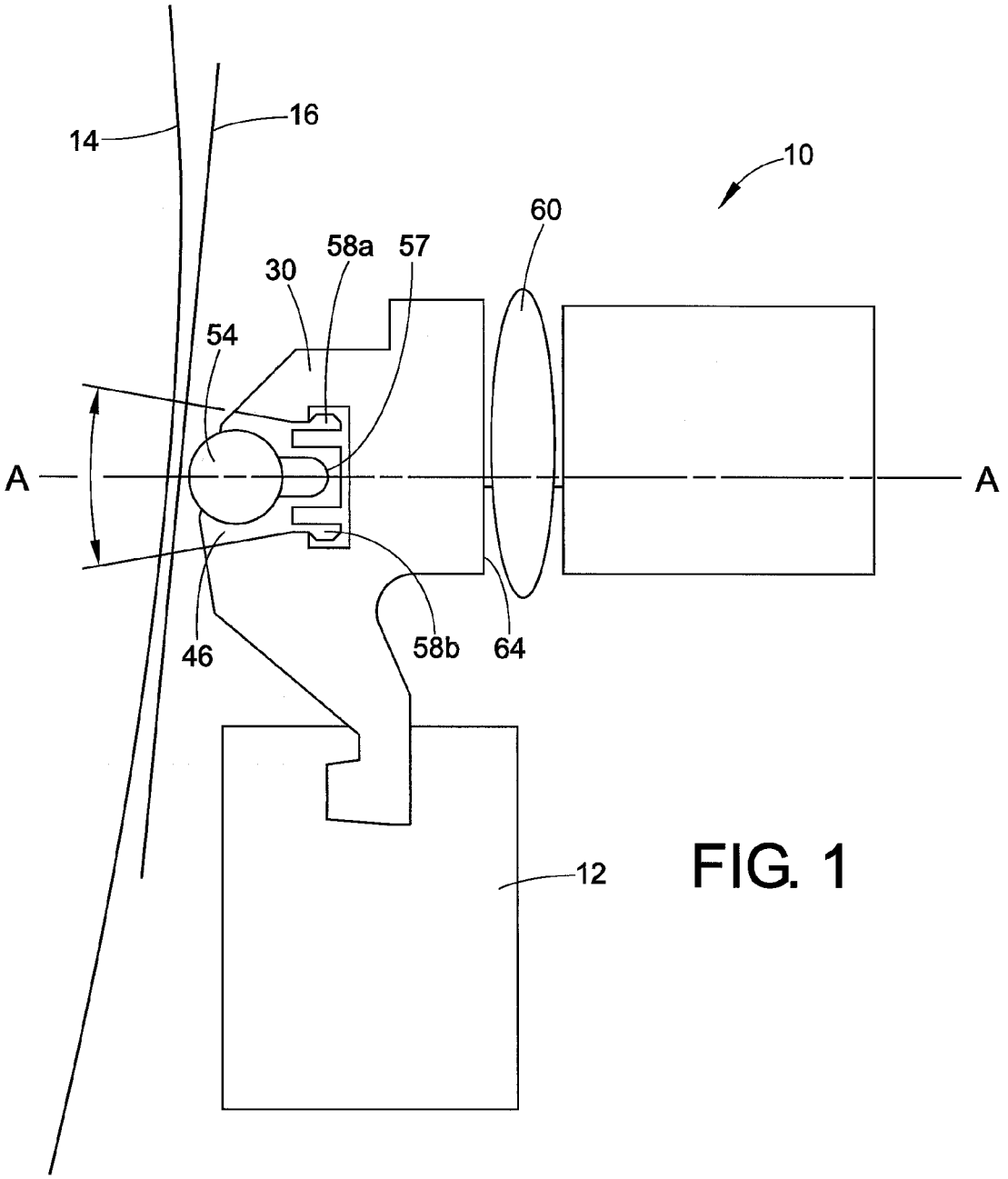
FIG. 1 is a cross-section of an exemplary metering rod assembly in accordance with the present disclosure.

With reference to FIG. 1, a metering rod assembly is illustrated and identified generally by reference numeral 10. The metering rod assembly 10 is illustrated as a component of a machine for applying a coating to paper during a paper manufacturing process. It will be appreciated that the metering rod assembly 10 is supported by a support 12 adjacent a roller 14 which advances a web of paper 16 between the metering rod assembly 10 and the roller 14. Although not shown, it is well known that an applicator is generally provided upstream of the metering rod assembly 10 for applying a coating liquid to the web 16. The coating is applied in excess and the metering rod assembly 10 is utilized to remove excess coating from the web 16 to achieve a desired coating thickness. The metering rod assembly 10 generally includes a base member 30 that is mounted to the support 12.

Figure 2:
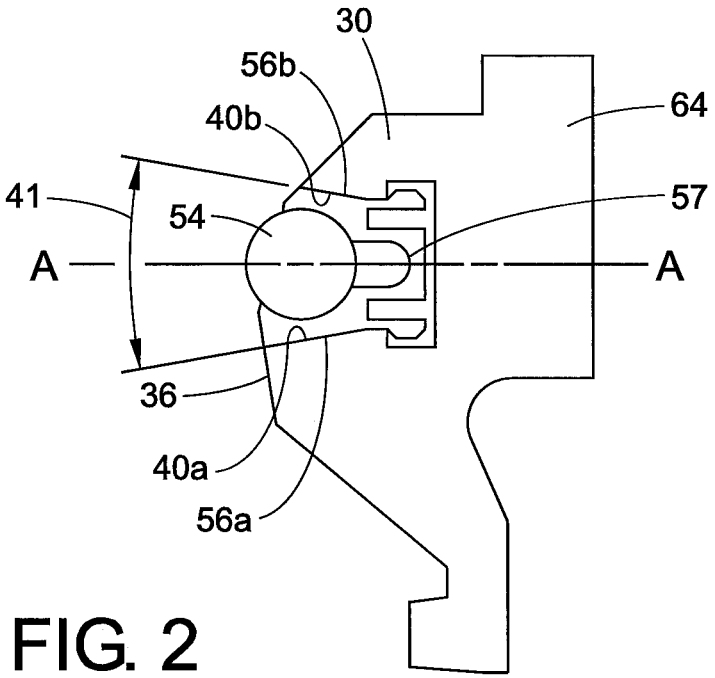
FIG. 2 is a cross-sectional view of a portion of the metering rod assembly of FIG. 1.
Figure 3:
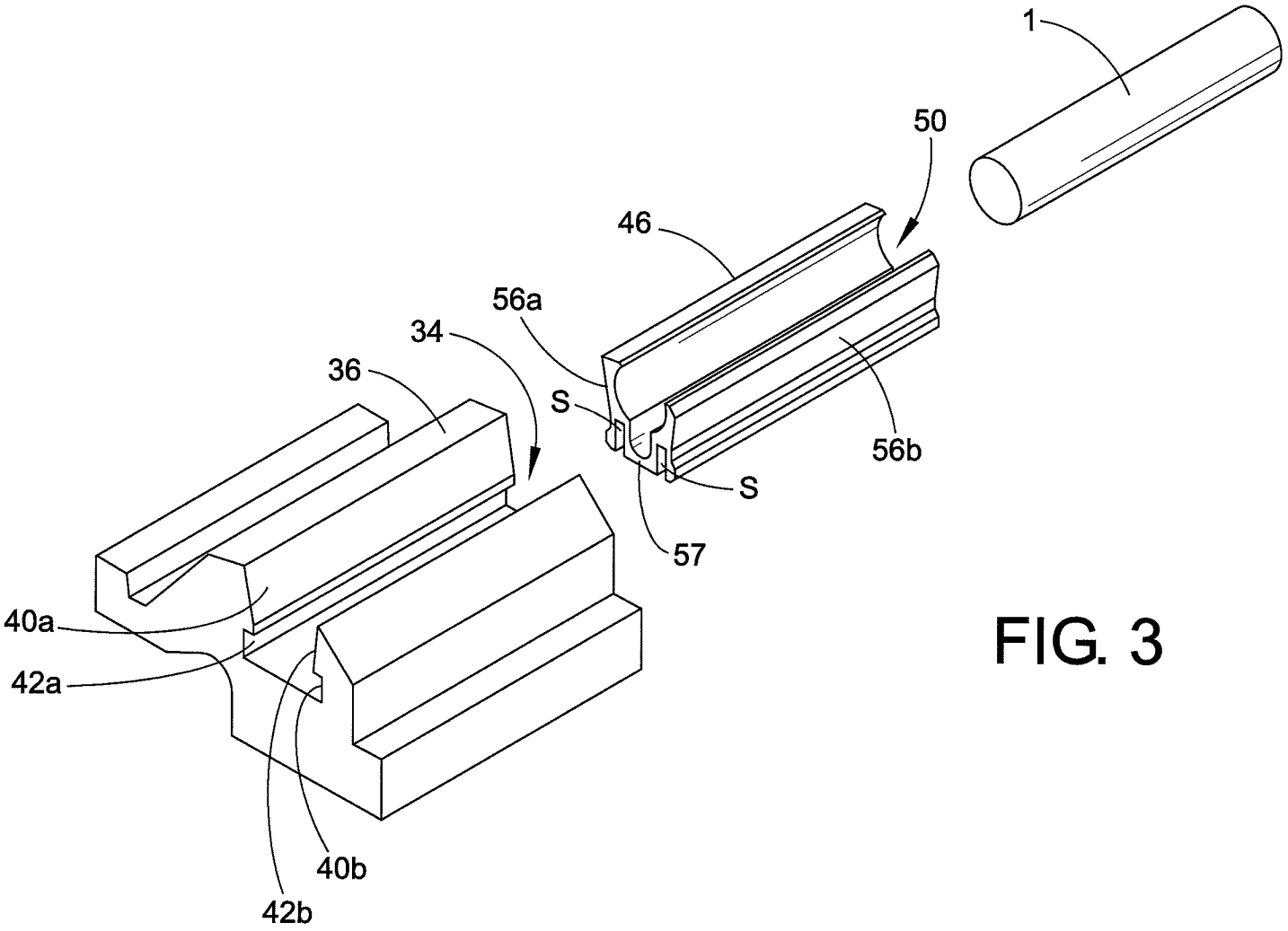
FIG. 3 is an exploded perspective view of several components of the exemplary metering rod assembly.

With additional reference to FIGS. 2 and 3, the base member 30 includes a channel 34 opening to a face or surface 36 thereof. The channel is generally defined by first and second sidewalls 40*a* and 40*b* that are spaced about a central plane A-A of the channel 34. In this embodiment, the first and second side walls 40*a* and 40*b* of the channel 34 extend at a non-zero angle 41 relative to a central plane A-A of the channel 34 such that the mouth of the channel 34 is wider than a base portion of the channel 34. The channel 34 further includes upper and lower retention slots 42*a* and 42*b* for receiving corresponding retention elements on a rod bed insert, as will be described below.

A rod bed insert 46 is received in the channel 34 and includes a metering rod slot 50 in which a metering rod 54 is supported. The rod bed insert 46 is configured to be closely received within the channel 34, with first and second sidewalls 56*a* and 56*b* of the insert 46 have a mating shape and slope to the first and second side walls 40A and 40B of the channel 34. The rod bed insert 46 includes a narrow or necked-down portion 57 connecting the first and second sidewalls 56*a* and 56*b* and a pair of spaced apart parallel longitudinally extending slots S allowing the insert 46 to flex about the necked-down portion 57 to accommodate insertion and/or removal of the metering rod 54 from the metering rod slot 50.

The rod bed insert 46 includes a pair of tab portions 58*a* and 58*b* that serve as retaining elements when the rod bed insert 46 is inserted in the channel 34. As best seen in FIGS. 1 and 2, the retention tabs 58*a* and 58*b* extend into corresponding retention slots 42*a* and 42*b* at the base of the channel 34. Once the tabs 58*a* and 58*b* are secured in the slots 42*a* and 42*b*, the interference between the tabs 58*a* and 58*b* and the base member 30 restricts withdrawal of the rod bed insert 46 from the channel 34.

Returning to FIG. 1, a pressure tube 60 is supported adjacent the base member 30 and configured to apply a force along the plane A-A to place the metering rod 54 in compressing engagement with the roller 14, as is conventional. In the illustrated embodiment, the pressure tube 60 acts along the plane A-A. The pressure tube 60 can also be configured to apply pressure along a plane offset from the plane A-A. Unlike prior art metering rod assemblies, a single pressure tube is utilized to not only place the metering rod 54 into compressive engagement with the roller 14, but also to clamp the metering rod 54 and/or rod bed insert 46 in the base member 30.

To this end, it will be appreciated that when force is applied to a rear surface 64 of the base member 30, the force is transmitted through the base member 30 and rod bed insert 46 to the metering rod 54. A reactive force is applied to the metering rod 54 by the roller 14 which tends to force the metering rod 54 deeper into the rod bed insert 46. The net effect is that surfaces 40*a* and 40*b* are urged towards each other thereby clamping the rod bed insert 46 and/or metering rod 54 in the channel 34 of the base member 30. As the force urges the insert 46 deeper into the channel 34, the interaction of the sloping surfaces 56*a* and 56*b* with sloping surfaces 40*a* and 40*b* urges the sides of the insert 46 together gripping the rod more tightly.

It will be appreciated that, for a given pressure applied to the base member 30 by the pressure tube 60, the clamping force can be altered by changing the angle of surfaces 40*a* and 40*b* relative to the plane A-A. For example, a relatively shallow angle, such as 20 degrees, will produce more clamping force on the rod bed insert 46 than a relatively steeper angle, such as 40 degrees. Accordingly, depending on the specific application, the clamping effect can be tuned to achieve desired performance. For example, an application requiring light pressure on the metering rod may benefit from a relative steep angle of side walls 40*a* and 40*b* (greater clamping force at lower pressure on the metering rod), while an application requiring higher pressure on the metering rod may benefit from a more shallow angle (less clamping force at higher pressure on the metering rod).

Figure 4:
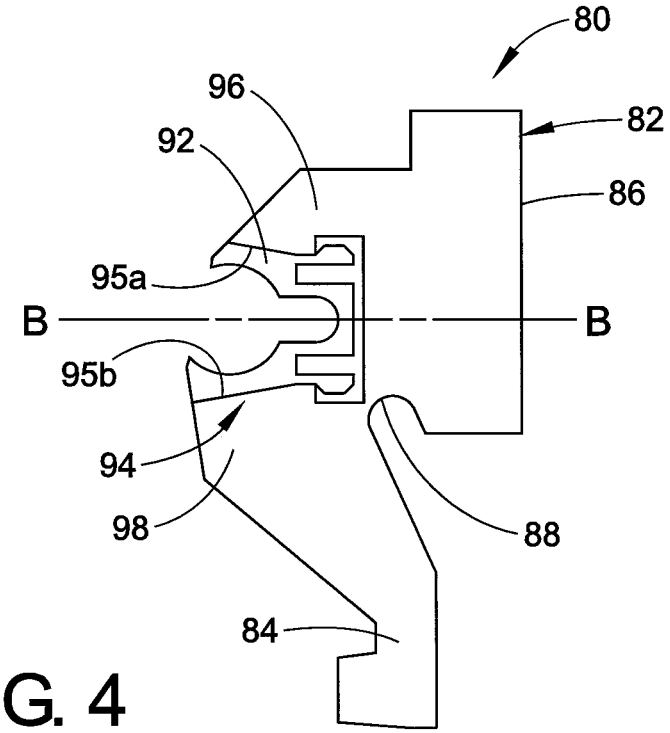
FIG. 4 is a cross-sectional view of another exemplary metering rod assembly in accordance with the present disclosure.

Turning to FIG. 4, another exemplary metering rod assembly is illustrated and identified generally by reference numeral 80. This embodiment is essentially identical to the metering rod assembly 10 of FIGS. 1-3, with the exception of a hinge feature of the base member. Accordingly, the assembly 80 includes a base member 82 having a mounting portion 84 adapted to be secured to a support (not shown), a head portion 86, and a reduced cross-section hinge portion 88 connecting the head portion 86 and the mounting portion 84. A rod bed insert 92 is received in a channel 94 of the base member 82 in a similar manner to the rod bed insert 46 of FIGS. 1-3. The channel 94 includes first and second side walls 95*a* and 95*b* spaced about an axis or plane B-B.

In this embodiment, the hinge portion 88 facilitates flexing of the head portion 86 relative to the mounting portion 84 when a force is applied to the head portion 86, such as by a pressure tube (e.g., pressure tube 60 of FIG. 1). Such flexing generally rotates the head portion 86 counterclockwise relative to the mounting portion 84 such that an upper jaw 96 including side wall 95*a* is urged towards a lower jaw 98 including side wall 95*b* thereby clamping the rod bed insert 92 and/or a metering rod in the channel 94 of the base member 82. In this embodiment, it may be advantageous to position the pressure tube to apply force to the head portion 86 at a position above plane B-B to increase the levering effect and clamping force generated.

As with the embodiment of FIGS. 1-3, the angle of side surfaces 95*a* and 95*b* relative to plane B-B can dictate the level of clamping force generated when the metering rod assembly is in use. Unlike the previous embodiment, however, the present embodiment optionally allows for elimination of the angled side walls of the channel 94 since the upper jaw 96 is urged towards lower jaw 98 resulting in a clamping effect independent of the clamping effect generated by angled side walls.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A metering rod holder assembly for supporting a metering rod in compressive engagement with an associated roller of a paper machine, the assembly comprising:

a base member mountable to a support, the base member having a tapered channel opening to a first face thereof, the tapered channel having a base portion and first and second side walls extending from the base portion and spaced about a central plane of the channel, the first and second side walls extending at non-zero angles relative to the central plane; and a replaceable rod bed insert at least partially received in the channel of the base member, the rod bed insert having a metering rod slot for receiving a metering rod, the rod bed insert including first and second side walls in abutting engagement with the first and second side walls of the base member;

wherein the rod bed insert is spaced apart from a base portion of the channel;

whereby, when a metering rod is installed in the metering rod slot, a force applied by an associated pressure tube parallel to the central plane placing the metering rod in compressive engagement with the associated roller urges said side walls of the rod bed insert towards each other thereby clamping the metering rod in the channel of the base member;

and wherein the rod bed insert is configured to be closely received in the channel, first and second side walls of the insert having a mating shape to the first and second side walls of the channel, the rod bed insert having spaced parallel longitudinally disposed slots to facilitate flexing of the rod bed insert.

2. The metering rod holder assembly as set forth in claim 1, wherein the rod bed insert includes a necked down portion thereof connecting the first and second side walls of the rod bed insert.

3. The metering rod holder assembly as set forth in claim 1, wherein the base member further includes a mount portion adapted to be secured to a support, a head portion, and a hinge portion connecting the mounting portion and the head portion.

4. The metering rod holder assembly as set forth in claim 3, further comprising a pressure tube for applying the force to the head portion of the base member, the pressure tube operative to compressively engage a metering rod with the associated roller and urge said side walls of the channel towards each other thereby clamping the rod bed insert in the channel of the base member.

5. The metering rod holder assembly as set forth in claim 1, wherein the metering rod insert includes a retaining element adapted to cooperate with a corresponding retaining element of the base member to restrict separation of the metering rod insert from the base member.

6. The metering rod holder assembly as set forth in claim 5, wherein the retaining elements include at least one protrusion and at least one recess into which the protrusion is received.

7. The metering rod holder assembly as set forth in claim 6, wherein the metering rod insert includes at least one tab including the at least one protrusion.

8. The metering rod holder assembly as set forth in claim 1, wherein at least one of the base member or the rod bed insert is comprised of a resilient material.

9. The metering rod holder assembly as set forth in claim 1, further comprising a pressure tube for applying the force to the base member, whereby when a metering rod is received in the metering rod slot, the pressure tube is operative to compressively engage the metering rod with the associated roller and clamp the rod bed insert in the base member.

10. The metering rod holder assembly as set forth in claim 1, wherein at least one of the first and second side walls of the channel extend at a non-zero angle relative to the central plane of the channel in a taper fit manner, whereby as the metering rod urges the rod bed insert deeper into the channel the first and second side walls of the base member clamp the rod bed insert channel.

11. A metering rod holder assembly for supporting a metering rod in compressive engagement with an associated roller of a paper machine, the assembly comprising:

a base member mountable to a support, the base member having a tapered channel opening to a first face thereof, the tapered channel having a base portion and first and second side walls extending from the base portion and spaced about a central plane of the channel, the first and second side walls extending at non-zero angles relative to the central plane;

a replaceable rod bed insert at least partially received in the channel of the base member, the rod bed insert having a metering rod slot for receiving a metering rod, the rod bed insert including first and second side walls in abutting engagement with the first and second side walls of the base member; and a pressure tube for applying the force to the base member;

wherein the rod bed insert is spaced apart from a base portion of the channel; and wherein the rod bed insert includes spaced parallel longitudinally extending slots to facilitate flexing of the rod bed insert, the longitudinally extending slots extending in a common direction along a length of the channel;

whereby, when a metering rod is installed in the metering rod slot, a force applied by an associated pressure tube parallel to the central plane placing the metering rod in compressive engagement with the associated roller urges said side walls of the rod bed insert towards each other thereby clamping the metering rod in the channel of the base member.

12. The metering rod holder assembly as set forth in claim 11, further comprising a metering rod received in the rod slot.

* * * * *